United States Patent [19]

Dobbs

[11] 4,247,008

[45] Jan. 27, 1981

[54] METHOD AND SYSTEM FOR SORTING ENVELOPES

[75] Inventor: William G. Dobbs, Tulsa County, Okla.

[73] Assignee: Stephens Industries, Inc., Lenexa, Kans.

[21] Appl. No.: 973,912

[22] Filed: Dec. 28, 1978

[51] Int. Cl.[3] ..... B07C 5/342

[52] U.S. Cl. ..... 209/569; 209/584; 209/900

[58] Field of Search ..... 209/584, 569, 900, 583

[56] References Cited

U.S. PATENT DOCUMENTS

| | | | |
|---|---|---|---|
| 3,889,811 | 6/1975 | Yoshimura | 209/900 X |
| 4,167,476 | 9/1979 | Jackson | 20/900 X |

*Primary Examiner*—Joseph J. Rolla

*Attorney, Agent, or Firm*—Lowe, Kokjer, Kircher, Wharton & Bowman

[57] ABSTRACT

The present invention deals with a microprocessor implemented method and system suitable for use in a mail sorting machine to sort the envelopes into common groups, assign each group a particular sort bin and generate a coded bin designation signal. The envelopes to be sorted are run through the machine in two passes. During the first pass, the system causes each of the envelopes to be deposited in a designated sort bin in accordance with a sort table which was programmed into the microprocessor prior to the first pass. The microprocessor also compiles a list of the zip codes of each envelope moving through the machine and maintains a count of the number of envelopes having each zip code. Once the first pass is completed, the microprocessor assembles the compiled zip codes into common groups and assigns each group a bin location. The microprocessor then assembles the bin locations into a sort table and outputs a list of loading instructions. During the second pass, the microprocessor directs each envelope into the sort bin designated by the sort table produced by the microprocessor after the first pass to thereby store each envelope of each group into its designated sort bin.

8 Claims, 5 Drawing Figures

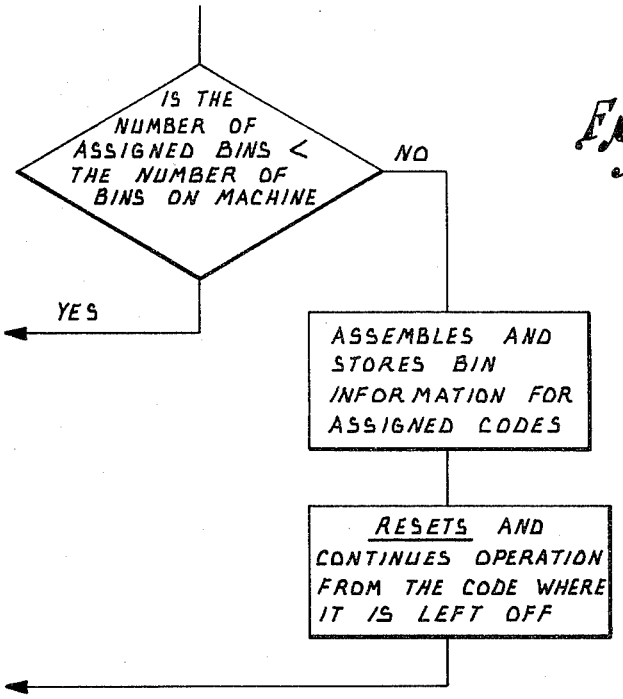
Fig. 5.
Fig. 3.
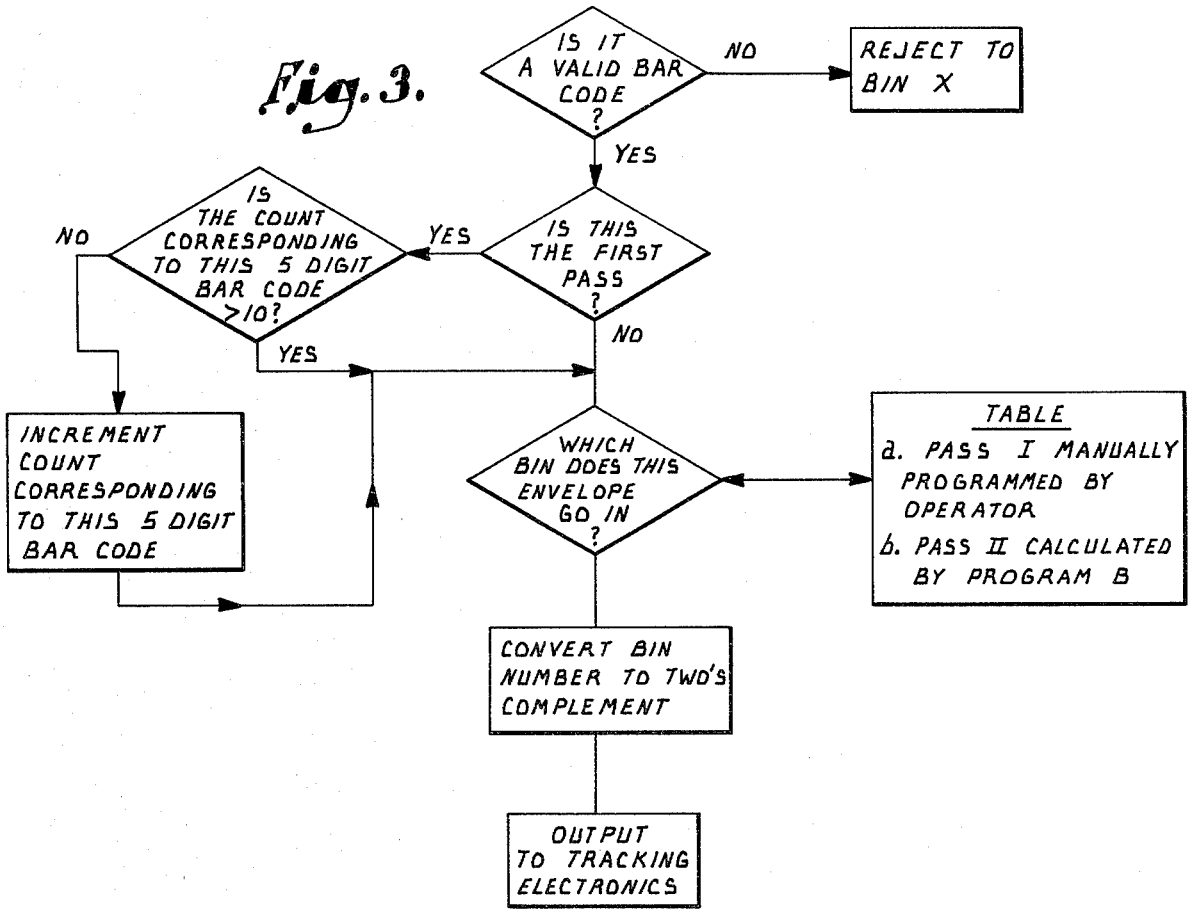

METHOD AND SYSTEM FOR SORTING ENVELOPES

BACKGROUND AND BRIEF DESCRIPTION OF THE INVENTION

This invention relates in general to the handling of mail within a mail sorting machine which is operable to receive a stack of envelopes, separate the envelopes from each other and successfully convey each of these envelopes to its designated sort bin through a single guideway formed by a plurality of deflecting gates. In particular, this invention deals with a microprocessor controlled method and system for automatically sorting the envelopes into common groups, assigning each group a particular sort bin and for generating a coded bin designation signal representative of the selected sort bin.

The volume of mail handled daily by large businesses, institutions and governmental entities has reached the point where new techniques and machines for automatically handling and sorting this mail more efficiently and economically must be developed. Although several machines for handling and sorting mail are presently available, these prior machines have not proven to be satisfactory for several reasons. For example, the presently existing mail sorting machines are normally very complex in design and operation and require the services of an operator to read a sort code imprinted on each envelope. These machines are typically comprised of an array of metal bands which form a plurality of guideways for transferring the received envelopes from a central sorting location to one of the machine's sort bins. In these machines, incoming envelopes are initially separated and successively provided to a read station where an operator reads sorting information imprinted on each envelope. The operator must then determine where this envelope is to be deposited and make the appropriate entry on the machine's keyboard to introduce the envelope into the guideway corresponding to the designated sort bin. This type of sorting technique is extremely inefficient because each envelope must be stopped at the read station so that the operator can read the sorting information imprinted on the envelope. Additional time is wasted waiting for the operator to determine where the envelope should be deposited and then depressing the button corresponding to the designated sort bin. Finally, envelopes sorted in this way are often directed to the wrong sort bin due to an error on the part of the operator.

It is therefore an object of the present invention to provide a microprocessor controlled system and technique for quickly and reliably reading the sort code imprinted on each envelope, sorting the envelopes into common groups, assigning each group a sort bin and generating a coded bin designation signal representative of the selected bin.

The microprocessor controlled system of the present invention receives sorting information from a reader which is positioned adjacent to the guideway through which the separated envelopes are being transported. This reader is capable of reading sorting information imprinted on each envelope as the envelope moves past the reader. As a result, the envelope does not have to be stopped for viewing by the reader or an operator thereby significantly increasing the speed at which envelopes may be sorted.

During the first pass, all of the envelopes to be sorted are run though the machine. The microprocessor causes each of these envelopes to be deposited in a designated sort bin in accordance with a sort table which was programmed into the microprocessor prior to the first pass. The microprocessor also compiles information concerning the zip code associated with each envelope moving through the machine during the first pass. In particular, the microprocessor creates a list of each zip code and maintains a count of the number of envelopes having a particular zip code.

Once the first pass is completed, the microprocessor assembles the compiled zip codes into common groups. In particular, all envelopes with the same five digit zip code are placed in a common group if there are ten or more envelopes with this zip code. Envelopes are also assembled into a common group if there are fifty or more envelopes with the same first three digits exclusive of the envelopes which have already been placed in a common group because there are ten or more of them with the same five digit zip code. The remaining envelopes are then put into a residual group. The microprocessor then assigns each of these common groups a bin location and assembles these bin locations into a sort table which is used during the second pass to direct each of the envelopes into its appropriate sort bin. The computing system also provides a list of instructions for loading of the envelopes during the second pass and for identifying which group of envelopes are stored in which sort bin.

The envelopes are then gathered for a second pass and put into the mail sorting machine in accordance with the instructions. During the second pass, the reader once again reads the sort code imprinted on each envelope as the envelope moves past the reader.

The microprocessor then compares the envelope's sort code with the sort table created by the computing system after the first pass and generates a coded bin designation signal which is representative of the sort bin in which the envelope is to be deposited. The coded bin designation signal moves through the mail sorting machine in synchronization with its associated envelopes to cause this envelope to be directed to its designated sort bin.

An additional object of the present invention is to provide a microprocessor implemented system of the character described wherein the amount of memory needed to implement the system is significantly reduced to thereby provide a substantial cost savings. Since the sort codes are stored within the microprocessor on a temporary basis, these codes are stored within random-access-memory units. The cost of random-access-memory is rather signficant when compared with the other components of the microprocessor. As a result, a substantial cost savings can be obtained by limiting the required amount of random-access-memory.

It is a further object of the present invention to provide a microprocessor implemented system of the character described wherein the amount of memory to implement the system is significantly reduced to thereby substantially increase the speed of operation. By reducing the number of memory locations, the speed of the central processing unit is correspondingly increased.

Other and further objects of this invention, together with the features of novelty appurtenant thereto, will appear in the course of the following description.

DETAILED DESCRIPTION OF THE INVENTION

In the accompanying drawings which form a part of the specification that are to be read in conjunction therewith and in which like reference numerals are employed to indicate like parts in the various views:

FIG. 3 is a flow chart of the sort routine executed by the microprocessor of the present invention;

FIG. 5 is a flow chart of the bin comparison routine executed by the microprocessor of the present invention.

Figure 1:
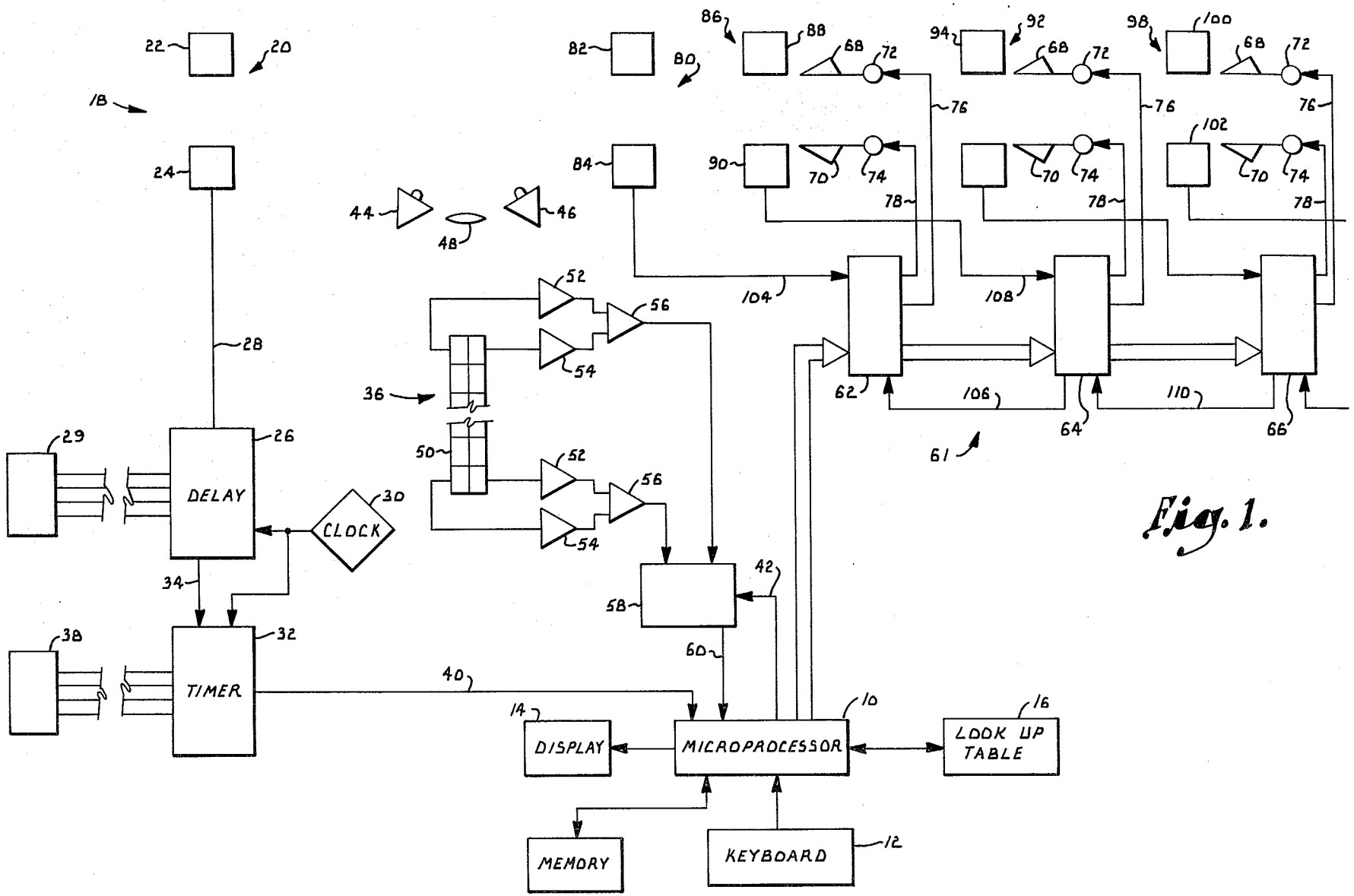
FIG. 1 is a diagrammatic representation of the mail sorting system of the present invention.
Figure 2:
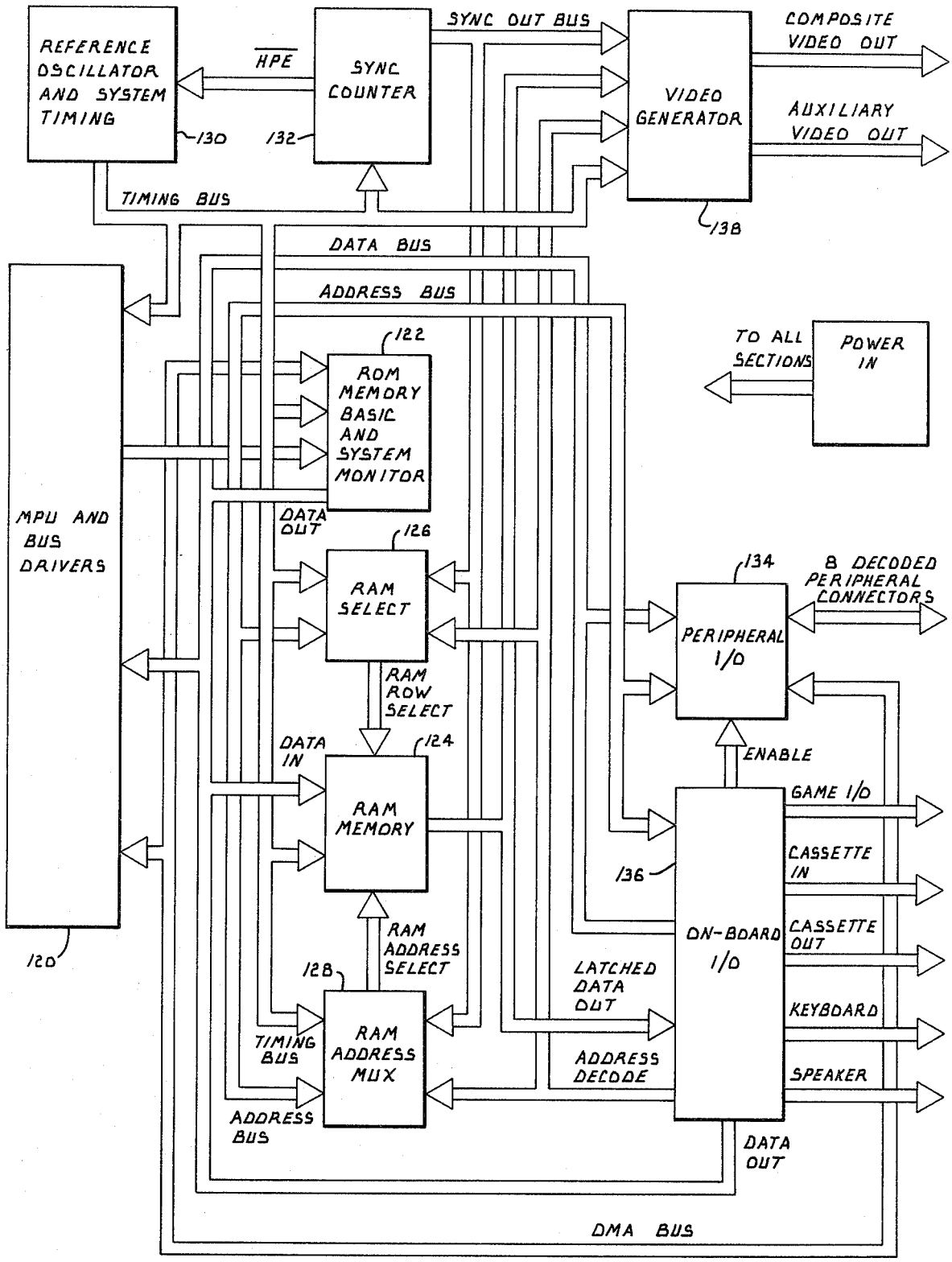
FIG. 2 is a block diagram of the microprocessor used in the mail sorting system of the present invention.

Referring now to FIG. 1, a mail sorting machine incorporating the mail sorting system of the present invention is diagramically illustrated in this figure. The decision-making entity of the mail sorting system is a microprocessor 10 which is operated under a hard-wired program or firmware control. The microprocessor is provided with an attendant keyboard device 12 for inputing information to and outputing information from the processor. A display device 14 is also provided to produce a visual display of the outputted information.

Prior to the first pass, an operator programs the bin assignments for the first pass into the microprocessor via the keyboard 12. The microprocessor uses these bin assignments to create a look up table 16 which is retained in memory for the duration of the first pass. Once the bin assignments have been programmed into the microprocessor, the stack of envelopes to be sorted is placed on the machine's input magazine which is not shown in FIG. 1. The machine then separates each of the incoming envelopes and successively conveys them down a guideway 18 toward the machine's sort bins.

It should be noted that each of the envelopes has sorting information inprinted on them. This sorting information is typically representative of the zip code corresponding to the envelope. The sorting information may, however, be representative of other features such as an office or departmental designation for sorting incoming mail. The sorting information is imprinted on each envelope in the form of a bar code or a magnetic code with the type of sort code being determined by the type of reader incorporated into the mail sorting machine on which the envelopes are to be sorted.

As the envelope moves down the guideway, it passes between the operable components of envelope sensor 20. Envelope sensor 20 is comprised of a light source 22 and a photosensor 24 which are positioned on opposite sides of the guideway such that an envelope moving down the guideway intercepts the beam of light which normally impinges on the photosensor. As an envelope intercepts this beam of light, the photosensor generates an activation signal which is provided to a delay circuit 26 as represented by a conductor line 28. Delay circuit 26 is a programmable digital counter having a maximum count state established by program switches which are generally represented by the numeral 28. Upon receipt of an activation signal from photocell 24, delay circuit 26 initiates its counting sequence. The count state of this digital counter is incremented in response to clock pulses which are provided to this circuit by clock 30. Upon obtaining its maximum count state, delay circuit 22 resets itself to a zero count state and provides an enable signal to timer circuit 32 via conductor line 34. The maximum count state of the delay circuit is selected to produce a time period equal to the amount of time it takes for the envelope to move from the envelope sensor 20 to a position wherein the sort code imprinted on the envelope is positioned directly in front of the machine's reader device 36.

Upon receipt of an enable signal, timer 32 begins counting a preselected number of clock pulses with the number of clock pulses being controlled by means of programming switches which are generally designated by the numeral 38. The clock pulses are derived from clock 30 and the number of clock pulses is selected to correspond to the period of time during which the sort code imprinted on the envelope is passing in front of the reader device. The timer circuit is operable to provide an output signal during the period of time it is counting. This output signal is in turn provided to the microprocessor as represented by conductor line 40. Upon obtaining its maximum count state, timer circuit 32 resets itself to a zero count state and inhibits the output signal present on conductor line 40.

The microprocessor responds to the output signal from the timer 32 by generating a read signal which is provided to the reader device 36 by means of a conductor line 42. Reader device 36 is a electro-optical reading device which is well known to those of ordinary skill in the art. Such a electro-optical reader is given and described in the U.S. Patent to Harms, Jr., etal. No. 3,886,328, issued May 27, 1975, which is incorporated herein by reference. This reader is basically comprised of a pair of light sources 44 and 46 for illuminating the bar code imprinted on an envelope passing in front of the reader device. The reader is also equipped with an objective lens 48 for focusing the light reflected from the bar code onto an array of photosensors which is generally designated by the numeral 50. The output of each of these photosensors is in turn coupled with an amplifier which is comprised of a plurality of operational amplifiers such as 52, 54 and 56. The amplified signal which is produced by each of these amplifiers is then provided to the reader's control logic circuitry which is generally designated by the numeral 58. The control logic circuitry controls the operation of the reading device and is operable to produce an output wave form which is representative of the bar coded data read by the device. This wave form is then provided to the microprocessor by means of a conductor line 60.

Upon receipt of an output signal from timer 32, the microprocessor provides a read signal to the reader's control logic circuitry 58. The reader's control logic circuitry responds to this signal by initiating its reading operation. In particular the reading device reads the bar code imprinted on the envelope and generates a wave form which is representative of this data. This wave form is then provided to the microprocessor where it is examined to determine if it meets the criteria of a valid bar code. If the wave form does not meet this criteria, the microprocessor momentarily inhibits the read signal produced by it thereby causing the reader to begin searching for another bar code. If a valid bar code is not received within the time period established by the timer 32, the microprocessor classifies this envelope as a reject and searches through the sort table for the sort bin assigned to the reject envelopes. The microprocessor then produces a coded bin designation signal which is representative of this sort bin.

The microprocessor responds to the receipt of a valid bar code within the time period established by timer 32, on the other hand, by converting this wave form into a zip code. The microprocessor then searches through the sort table for the bin location pertaining to this zip code and generates a coded bin designation signal which is representative of this bin location. The microprocessor also searches its working storage to determine if this zip code has already been allocated a memory location. If this zip code has not been allocated a memory location, the microprocessor allocates to this zip code a memory location in which the zip code and an attendant count are stored. If, on the other hand, this zip code has already been allocated a memory location, the microprocessor simply increments the count associated with this zip code. In this way, the microprocessor is operable to compile a list containing the zip code of each envelope passing through the machine during the first pass and to generate a count which is equal to the number of envelopes having each of the stored zip codes.

The coded bin designation signal is then provided to the electronic tracking system 61 where it is used to direct its associated envelope to its designated sort bin. The electronic tracking system is comprised of a plurality of individual tracking circuits such as 62, 64 and 66. These circuits are interconnected in series and cooperate with each other to transfer a coded bin designation signal between them in synchronization with the movement of an envelope through the mail sorting machine. Each of these tracking circuits is arranged to control the position of a pair of associated deflecting gates 68 and 70 in response to the coded bin designation code presently stored within the circuit. These gates are positioned adjacent to each other on opposite sides of the guideway to form a channel through which an envelope may be conveyed. Deflecting gates 68 and 70 are physically coupled with solenoids 72 and 74 which are in turn electrically coupled with their corresponding tracking circuit by means of conductor lines 76 and 78, respectively. Each tracking circuit is also provided with an associated envelope sensor which is anteriorly positioned with respect to its associated tracking circuit to alert this circuit of an approaching envelope. In particular, envelope sensor 80 which is comprised of a light source 82 and a photocell 84 is associated with tracking circuit 62 while envelope sensor 86 is associated with tracking circuit 64 and is comprised of a light source 88 and a photocell 90. The envelope sensor associated with tracking circuit 66, on the other hand, is generally designated by the numeral 92 and is comprised of a light source 94 and a photocell 96. Finally, envelope sensor 98 which is comprised of a light source 100 and a photocell 102 is associated with a tracking circuit which is not shown in this figure. The light source and photocell of each envelope sensor are positioned on opposite sides of the guideway and are orientated such that an envelope passing through the guideway intercepts the beam of light transmitted onto the photocell by the light source.

As the envelope moves between the components of envelope sensor 80, photocell 84 generates an alert signal which is provided to the first tracking circuit 62 as represented by conductor line 104. Upon receipt of this alert signal, the first tracking circuit accepts from the microprocessor the coded bin designation signal which is associated with the approaching envelope. The tracking circuit then processes this signal and examines the processed signal to determine if it is representative of one of this circuit's associated deflecting gates. If the coded bin designation signal is representative of one of the deflecting gates associated with the first tracking circuit, this circuit energizes this gate's attendant solenoid by providing a power signal to this solenoid by means of conductor lines 76 or 78 depending upon which gate is to be activated. Activation of the solenoid causes its attendant deflecting gate to be moved from the normal position shown in FIG. 1 to a deflect position wherein the gate is located within the guideway to engage and direct an advancing envelope into the sort bin associated with this deflecting gate. If, on the other hand, the coded bin designation signal is not representative of either of the deflecting gates associated with this tracking circuit (62), the coded bin designation signal is simply stored within this tracking circuit until a clear signal is provided to this circuit from the second tracking circuit 64 by means of conductor line 106. In addition, neither of the gates associated with tracking circuit '62 are activated to thereby allow an envelope to pass between them unimpeded.

Passage of an envelope between the components of envelope sensor 86 causes an alert signal to be provided from photocell 90 to the second tracking circuit 64 as represented by conductor line 108. The second tracking circuit responds to this alert signal by accepting the coded bin designation signal presently stored within the first tracking circuit and generating a clear signal which is in turn provided to the first tracking circuits by means of conductor line 106. This tracking circuit then processes the received designation signal and examines the processed signal to determine if it is representative of either of the deflecting gates associated with this tracking circuit. If the signal is not representative of either of these gates, the signal is simply stored within this circuit until a clear signal is received from tracking circuit 66 by means of conductor line 110. If, on the other hand, the processed signal is representative of one of the deflecting gates associated with the second tracking circuit, this circuit causes the solenoid associated with this gate to be activated thereby moving the designated deflecting gate into the guideway to direct an advancing envelope into the sort bin associated with this deflecting gate.

The coded bin designation signal is thus moved through the electronic tracking system in synchronization with the movement of its associated envelope through the mail sorting machine. Each tracking circuit processes and examines the signal to determine if it is representative of either of the deflecting gates associatd with this circuit. The tracking circuit associated with the deflecting gate designated by the coded bin designation signal responds to the receipt of this signal. Activation of this solenoid causes its attendant deflecting gate to be moved into the guideway to interrupt the normal movement of an advancing envelope and thereby direct this envelope into the sort bin associated with this deflecting gate. Each of the incoming envelopes is sorted in this manner during the first pass.

Upon completion of the first pass, the microprocessor processes the stored data to separate the envelopes into common groups and to assign a sort bin to each of the assembled groups. In particular, the processor arranges the stored zip codes in numerical order and then examines the count corresponding with each of the stored zip codes. The microprocessor begins by examining in succession the count of each zip code falling within a comparison range of 00000 to 00099. If the count corresponding with any of the zip codes in this range is ten or greater, each of these zip codes is classified as a separate group and is assigned its own sort bin. Thereafter, the remaining zip codes with a number between 00000 and 00099 are combined together and their individual counts are summed. The resulting sum is then examined to determine if it is greater than fifty. If the resulting sum is greater than fifty, these zip codes are then grouped together and assigned a sort bin. If the resulting sum is less than fifty, however, these zip codes are not grouped together and each of these zip codes is assigned to the residual sort bin. The microprocessor then increments the comparison range by "100" and performs the above-described grouping and assigning operation on each of the zip codes within the range of 00100 to 00199. The microprocessor continues to operate in this manner until all of the zip codes have been assigned to a particular sort bin.

Each time a sort bin is assigned to a zip code or group of zip codes the microprocessor compares the number of assigned bins with the total number of bins in the mail sorting machine. If the number of assigned bins is less than the total number of bins in the machine, the microprocessor just continues on with the above-described grouping and assigning operation. Quite often, however, the number of zip codes or groups of zip codes to be assigned sort bins exceeds the number of sort bins in the machine. In that case, the second pass will have to include a number of separate runs with a portion of the envelopes being inputted to the machine during each run of the second pass in accordance with loading instructions generated by the microprocessor. The first sort bin is always reserved for the residual envelopes and serves as the bin in which the envelopes with an invalid bar code and the ones which do not fall within one of the common groups are deposited. The microprocessor then assigns the remaining bin in numerical order. The microprocessor then creates a sort table which contains the bin assignment for each run of the second pass and prepares loading instructions which are subsequently outputted to the operator. These loading instructions provide the operator with information concerning which of the envelopes are to be fed into the machine during each run of the second pass and information concerning the location of the sorted envelopes after each run.

While the microprocessor is performing the above-described grouping and assigning operation, the envelopes sorted during the first pass are being removed from the mail sorting machine by the operator. Thereafter, the envelopes are fed into the mail sorting machine in accordance with the loading instructions generated by the microprocessor. The incoming envelopes are initially separated from each other and conveyed through the mail sorting machine in succession. As each envelope moves through the machine the bar code imprinted on the envelope is read and converted into a wave form by the reading device. Thereafter, the microprocessor examines this wave form to determine if it is representative of a valid bar code and generates a coded bin designation signal which is representative of the sort bin in which the envelope is to be deposited. The microprocessor generates the coded bin designation signal by searching through the sort table which was created by the microprocessor following the first pass. The coded bin designation signal is then transferred to the electronic tracking system where it is used to direct its associated envelope into the appropriate sort bin.

Referring now to FIG. 5, a more detailed diagram of the microprocessor's hardware is given in this figure. The microprocessor is operated under a hardwired program of firmware control to perform the desired functions. The microprocessor may comprise any one of a plurality of microprocessor configurations which are operable to simulate a dedicated, stored program digital computer. The utilized system, however, should include a central processing unit which is capable of performing arithmetic, logical, manipulative and control functions upon digital information including digital instructions and data; read-only-memory or programmable read-only-memory which is capable of storing firmware instructions used in the performance of control and/or monitoring functions; random-access-memory which is capable of storing intermediate results and/or other changeable digital information received by or generated within the computing system; timing circuitry which is capable of coordinating the various processing operatings performed by the system; and input/output circuitry which is capable of transferring data instructions from an outside recording medium directly into memory and for transferring data instructions from memory to an outside recording medium. Since many different systems exhibiting these characteristics are well known to those of ordinary skill in the art, an exhaustive description of each block will not be undertaken at this time.

The microprocessor shown in FIG. 5 represents a microprocessor which is well suited for use in the present invention and a general description of this system will be undertaken herein. The computing system shown in FIG. 5 comprises an Apple II computing system which is manufactured by Apple Computer, Inc. Schematic, functional and programming information for this computing system is provided by Apple Computer, Inc. in a publication entitled Apple II Reference Manual, January 1978, which is incorporated by reference herein.

A central processing unit 120 forms the heart of the computing system. The central processing unit is comprised of an MCS 6502 central processing unit which is manufactured by Mos Technology, Inc. This central processing unit includes an arithmetic and logic unit, instruction register, a control unit, plus interface logic, clock logic circuitry and a number of programmable registers including an accumulator, a pair of index registers, a program counter, a stack pointer, and a status register. A more detailed description of this circuit and its operation is given in the Syne-tex Mos Data Catalog, which was published January of 1978 and is incorporated by reference herein. The microprocessor includes a read-only-memory 122 for holding program data including instructions and program commands. Since the contents of the read-only-memory cannot be altered by the central processing unit, the read only memory contains a hardwired program or firmware for controlling the operation of the microprocessor.

In addition to the read-only-memory, this microprocessor includes working storage in the form of a random-access-memory 124. This random-access-memory is constructed of dynamic RAM chips which are designed to provide 16,384×1 bits of memory. These chips are arranged in sets of eight to interace with the central processing unit. The present microprocessor is constructed to have 48K locations of RAM memory available. The microprocessor also includes a RAM select circuitry 126 and a RAM address multiplexer 128 for inputting data to and outputting data from the RAM memory.

System timing is controlled by the reference oscillator and system timing circuit 130 which operates in combination with the sync counter 132. These two circuits cooperate to generate the clock signals needed to drive the central processing unit and the other operable equipment of the system and to coordinate the operation of this equipment.

The computing system is also provided with a peripheral input/output device 134, an on-board input/output device 136 and a video generator 138 for receiving an outputting data from external sources. In particular, the peripheral I/O circuitry is operable to connect the microprocessor with additional equipment while the on-board I/O, is used to couple the microprocessor with an associated keyboard to receive and output data. The video generator, on the other hand, is operable to provide a video display of the data to be outputted.

Reference is now made to FIG. 3 for a more detailed description of the sorting operation performed by the microprocessor of the present invention. Upon receiving a bar code from the reading device, the microprocessor performs a quality check on the received code to determine if it meets the criteria for a valid bar code. If the received information does not meet this criteria, the microprocessor directs the envelope associated with this bar code to the reject bin by assigning to this envelope the coded bin designation signal which is representative of the reject bin.

If, on the other hand, the received code meets the criteria for a valid bar code, the microprocessor converts the received bar code into a zip code and then determines whether this is the first or second pass. During the first pass, the microprocessor examines its working storage to determine if this zip code has already been allocated a memory location. If a memory location has not been allocated to this zip code, the microprocessor allocates a memory location to this zip code and initiates a count which is representative of the number of envelopes having this zip code. If, on the other hand, a memory location has been allocated to this zip code, the microprocessor reviews the count associated with this zip code to determine if it is ten or greater. The microprocessor responds to a count of less than ten by incrementing the count associated with this zip code and then ascertaining the bin in which the envelope is to be deposited. A count of ten or greater, however, causes the microprocessor to ascertain the bin in which the envelope is to be deposited without incrementing the count associated with this zip code.

During the first pass, the microprocessor ascertains which sort bin an envelope is to be deposited in by searching through the sort table which was programmed into the microprocessor prior to initiating this pass. The sort table used during the first pass is programmed to perform a general separation of the envelopes according to numerical order. In particular, this sort table is aranged so that each sort bin has a range of zip codes assigned to it. For example, the sort table may be set up so that all of the envelopes with a zip code between 00000 and 00100 are deposited within the second sort bin while all of the envelopes with a zip code between 00101 and 00199 are deposited within the third sort bin and so on. The number of zip codes assigned to each sort bin is variable and may be adjusted to accommodate the zip code distribution of the envelopes to be sorted.

The microprocessor then generates a coded bin designation signal which is representative of the sort bin in which the envelope is to be deposited. The coded bin designation signal is then provided to the electronic tracking system where it is used to direct this envelope to its designated sort bin.

Figure 4:
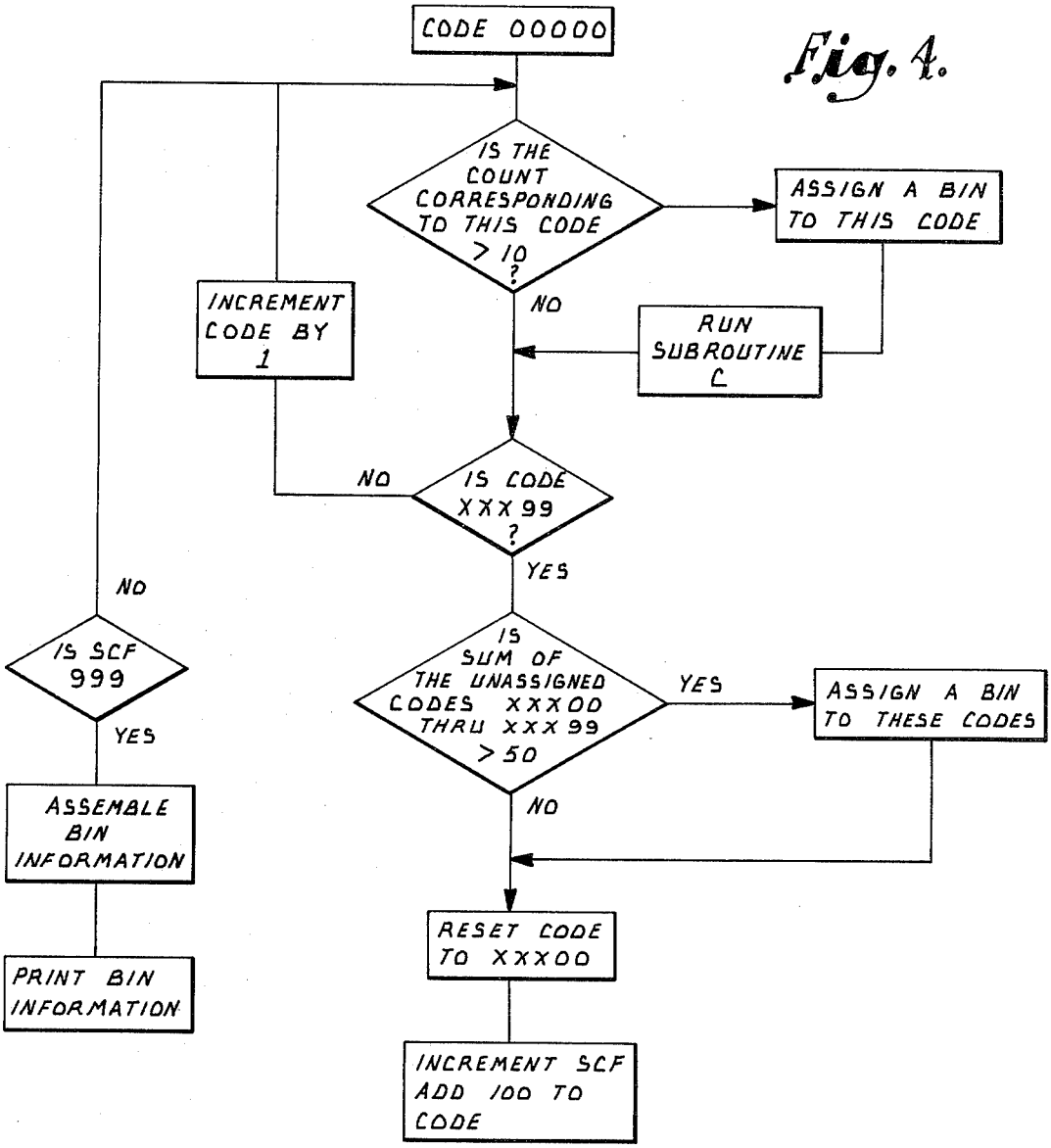
FIG. 4 is a flow chart of the assigning routine executed by the microprocessor of the present invention.

Once the first pass has been completed, the microprocessor initiates the grouping and assigning routine shown in FIG. 4. Upon initiating this routine, the microprocessor generates a comparison zip code which is "00000". The microprocessor then searches through the compiled list of zip codes to determine if the count corresponding to this zip code is ten or greater. If the count corresponding to this zip code is ten or greater, the next sort bin is assigned to this zip code. It should be noted that the first bin is reserved for the envelopes that do not have a valid bar code imprinted on them and for the residual envelopes which do not fit within any of the common groups. As a result, the second sort bin is the first bin available for receiving the envelopes which fall within one of the common groups.

Once this zip code has been assigned a sort bin, the microprocessor initiates subroutine C. A flow chart of subroutine C is given in FIG. 5. In this subroutine, the microprocessor checks to see how many of the machine's sort bins have been assigned. In particular, the number of assigned bins is compared with the number of bins contained in the mail sorting machine. If the number of assigned bins is less than the total number of bins in the machine, the microprocessor returns to the grouping and assigning routine shown in FIG. 4. If, on the other hand, the number of assigned bins is not less than the total number of bins in the machine, the microprocessor classifies the assigned bins as a run and assembles and stores the bin information associated with this run. As pointed out above, a number of different runs may have to be established to accomodate all of the envelopes. The microprocessor then generates a loading instruction for this run. In particular, these instructions provide information concerning which of the envelopes are to be loaded during the run and information concerning which group of envelopes are to be deposited in each sort bin during this run. The microprocessor then conditions itself to begin assigning sort bins for another run and returns to the grouping and assigning routine shown in Fig. 4.

If the count corresponding to the present comparison zip code is not ten or greater, the microprocessor simply examines the comparison zip code to determine if its last two digits are "99" without assigning a separate sort bin to this zip code. This comparison is also made if the count corresponding to this zip code was ten or greater. In that case, however, the comparison is only made after a sort bin has been assigned to this zip code and a subroutine C has been completed.

If the last two digirs of the comparison zip code are not "99", the microprocessor increments the last digit of the comparison zip code and searches through its working storage for the count corresponding to this zip code as described above. If the count corresponding to this comparison zip code is ten or greater, a sort bin is assigned to this zip code as described above and subroutine C is initiated. Thereafter, the last two digits of the comparison zip code are then compared to determine if they are "99". If the count state corresponding to this comparison zip code is less than ten, the last two digits of this zip code are compared to determine if they are "99" without assigning this zip code a sort bin. The microprocessor continues to circulate in this loop until the last digits of the comparison zip code become "99".

Thereafter, the count of all of the zip codes having the same first three digits as the comparison zip code exclusive of the zip codes which have already been assigned a sort bin are summed. The resulting sum is then compared to determine if it is fifty or greater. If the resulting sum is less than fifty, all of the zip codes which fall within this range exclusive of the ones which have already been assigned a sort bin are assigned to the residual bin. Thereafter, the last two digits of the present comparison zip code are reset to "00" and the comparison zip code is incremented by "100". If the resulting sum is fifty or greater, this group of zip codes are assigned a bin as described above. Thereafter, subroutine C is initiated to determine if the assigned number of bins is less than the number of bins in the mail sorting machine. Upon completion of subroutine C, the last two digits of the present comparison zip code are reset to "00" and the comparison zip code is incremented by "100".

Once the comparison zip code has been incremented by "100", the first three digits of the comparison zip code are compared to determine if they are "999". If the first three digits of the comparison zip code are not "999", the microprocessor returns to the start of this routine to begin its comparing operation anew. If the first three digits are "999", the microprocessor assembles the bin information into a sort table for use during the various runs of the second pass. The loading instructions prepared by the microprocessor are then printed. In this way, the microprocessor is capable of examining every zip code to determine if its corresponding count is ten or greater and of assigning a sort bin to each code having a corresponding count which is ten or greater. The microprocessor is also capable of assembling the unassigned zip codes with the same first three digit into a common group and of summing the count's corresponding to each of these zip codes to determine if it is fifty or greater. the microprocessor then assigns this group of zip codes to a specific sort bin if the resulting count is fifty or greater. Any zip codes which do not fall within either of these two categories are assigned to a residual bin.

Reference is now made to FIG. 3 for a description of the microprocessor during the second pass. During each run of the second pass, the envelopes designated by the loading instructions for that run are loaded into the mail sorting machine. As the bar code on an envelope is read, the microprocessor examines this code to determine if it meets the criteria for a valid zip code. If this bar code does not meet the required criteria, the envelope is assigned to the reject bin. Recognition of a valid bar code causes the microprocessor to determine which pass this is. Since this is now the second pass, the microprocessor immediately proceeds to ascertain which sort bin this envelope is to be deposited in by searching through the sort table created by the microprocessor following the first pass. Once the appropriate sort bin has been ascertained, the microprocessor generates a coded bin designation signal which is representative of this sort bin. The coded bin designation signal is then provided to the electronic tracking system where it is used to direct its associated envelope to its designated sort bin.

Having this described the invention, I claim:

1. A microprocessor implemented method for sorting and assigning sort bins to a plurality of randomly distributed envelopes being handled by a mail sorting machine having a plurality of sort bins for receiving and sorting envelopes and means for directing an envelope to one of said sort bins in accordance with an associated bin designation signal, each of said envelopes having an associated zip code which may be readily ascertained but which may be in any sequence prior to the sorting thereof, said method comprising the steps of:

compiling a list of each zip code associated with one or more of said envelopes and a count which is representative of the number of envelopes having each zip code of said list, assigning a sort bin to each zip code on said list which has an associated count greater than a first preselected number, arranging the zip codes on said list which have not been assigned a sort bin into groups such that all of the zip codes which have not been assigned a sort bin and have the same first three digits are assembled into a common group, summing the count associated with each zip code in a common group to provide a resulting sum for each common group, assigning the sort bin to each common group having a resulting sum which is greater than a second preselected number.

2. The method as in claim 1 including the step of assigning a sort bin to each zip code in each common group which does not have a resulting sum which is greater than said second preselected number.

3. The method as in claim 1 wherein said compiling step comprises the steps of:

ascertaining the zip code on each of said envelopes in succession, establishing a count corresponding to a particular zip code if a count corresponding to said particular zip code has not already been established, and incrementing the count corresponding to a particular zip code if a count corresponding to said particular zip code has already been established.

4. The method as in claim 1 wherein the step of assigning a sort bin comprises the steps of incrementing a bin count each time a sort bin is assigned, comparing said bin count with a third preselected number, producing bin information concerning the assigned sort bins if said bin number exceeds said third preselected number, and establishing another bin run wherein the sort bins of the mail sorting machine which were assigned during the previous run are reassigned.

5. A microprocessor implemented method for sorting and assigning sort bins to a plurality of envelopes being handled by a mail sorting machine having a plurality of sort bins for receiving and storing envelopes, means for directing an envelope to one of said sort bins in accordance with an associated bin designation signal, each of said envelopes having an associated zip code which may be readily ascertained, said method comprising the steps of:

compiling a list of each zip code associated with one or more of said envelopes and a count which is representative of the number of envelopes having each zip code in said list, assigning a sort bin to each zip code which falls within a preselected range of numbers and has a count state which is greater than a first preselected number, summing the count state associated with each zip code which falls within said preselected range of numbers and does not have a count greater than said first preselected number to thereby produce a resulting sum, and assigning a sort bin to each zip code which falls within said preselected range of numbers if said resulting sum is greater than a second preselected number.

6. The method as in claim 5 including the step of assigning a sort bin to each zip code in each common group which does not have a resulting sum which is greater than said second preselected number.

7. The method as in claim 5 wherein said compiling step comprises the steps of:

ascertaining the zip code on each of said envelopes in succession, establishing a count corresponding to a particular zip code if a count corresponding to said particular zip code has not already been established, and incrementing the count corresponding to a particular zip code if a count corresponding to said particular zip code has already been established.

8. The method as in claim 5 wherein the step of assigning a sort bin comprises the steps of incrementing a bin count each time a sort bin is assigned, comparing said bin count with a third preselected number, producing bin information concerning the assigned sort bins if said bin number exceeds said third preselected number, and establishing another bin run wherein the sort bins of the mail sorting machine which were assigned during the previous run are reassigned.

* * * * *

UNITED STATES PATENT AND TRADEMARK OFFICE

CERTIFICATE OF CORRECTION

PATENT NO. : 4,247,008

DATED : January 27, 1981

INVENTOR(S) : William G. Dobbs

It is certified that error appears in the above—identified patent and that said Letters Patent is hereby corrected as shown below:

On the title page, Item [73] should read:

--- Bell & Howell Company ---.

Signed and Sealed this

*Thirtieth* Day of *June 1981*

[SEAL]

*Attest:*

RENE D. TEGTMEYER

*Attesting Officer*

*Acting Commissioner of Patents and Trademarks*